United States Patent [19]

Faulkner, III

[11] Patent Number: 4,768,718

[45] Date of Patent: Sep. 6, 1988

[54] NOZZLE WITH INTERNAL VALVE FOR APPLYING VISCOUS FLUID MATERIAL

[75] Inventor: W. Harrison Faulkner, III, Pacific Grove, Calif.

[73] Assignee: Slautterback Corporation, Monterey, Calif.

[21] Appl. No.: 36,808

[22] Filed: Apr. 10, 1987

[51] Int. Cl.[4] ..... B05B 7/12

[52] U.S. Cl. ..... 239/410; 239/417; 239/533.1

[58] Field of Search ..... 239/410, 412, 407, 417.5, 239/533.1, 570; 137/895, 605

[56] References Cited

U.S. PATENT DOCUMENTS

| | | | |
|---|---|---|---|
| 2,551,538 | 5/1951 | Hensel | 299/106 |
| 3,202,363 | 8/1965 | Kautz et al. | 239/410 |
| 3,348,520 | 10/1967 | Lockwood | 118/2 |
| 3,406,905 | 10/1968 | Reilly et al. | 239/84 |
| 3,661,679 | 5/1972 | Law | 156/356 |
| 3,741,484 | 6/1973 | Cresswell | 239/424 |
| 3,976,247 | 8/1976 | Carmelo | 239/135 |
| 4,065,057 | 12/1977 | Durmann | 239/79 |

FOREIGN PATENT DOCUMENTS 483261 9/1929 Fed. Rep. of Germany ... 239/533.1

*Primary Examiner*—Andres Kashnikow
*Assistant Examiner*—Karen B. Merritt
*Attorney, Agent, or Firm*—Thomas Schneck

[57] ABSTRACT

A nozzle for applying a quasi-random splatter pattern of viscous fluid material. The nozzle includes an axially inward gas flow path and an axially outward material flow path. The material flow paths are partially defined by an array of material flow passageways that are yieldingly obstructed by a valve member. The valve member has a center bore to permit passage of a stream of gas. Pressurization of the viscous fluid material causes the material to exceed the threshold pressure for axial movement of the valve member. The viscous fluid material will thereafter flow to an outlet orifice having a configuration which is at least closely similar to the array of material flow passageways. Material at the outlet orifice is impinged by the stream of gas through the nozzle for projection to a surface.

17 Claims, 3 Drawing Sheets

NOZZLE WITH INTERNAL VALVE FOR APPLYING VISCOUS FLUID MATERIAL

DESCRIPTION

1. Technical Field

The present invention relates to apparatus for the dispensing of viscous fluid materials and in particular to apparatus for low pressure spraying of thermoplastic adhesive material and the like.

2. Background Art

Hot-melt adhesives are used in the automated packaging industry for sealing cases and cartons. Usually, melted adhesive is extruded under high pressure through a nozzle, the adhesive being applied to the major and minor flaps of cartons in long continuous strips. The use of high pressure to force hot-melt adhesives through nozzle orifices presents an occupational risk, since a rupture in the equipment could spray hot material in any direction. Furthermore, the expense of pressure resistant hoses, fittings and couplings could be eliminated if nozzle performance could equal that produced by high pressure equipment.

High pressure equipment is employed to ensure that an adequate amount of adhesive is forced through a particular nozzle orifice for sealing of a rapidly moving carton on an assembly line. Typically, cartons in an automated assembly line travel past a hot-melt adhesive dispenser at a rate of 400 to 600 feet per minute. Additionally, high pressure is utilized to minimize the occurrence of tailing, stringing, drooling, dripping and clogging between applications. U.S. Pat. No. 3,348,520 to Lockwood, for example, discloses an applicator having a pump structure which produces high pressure strokes and suctions to operate check valves for reducing dripping between applications.

While cartons on an automated assembly line normally are oriented with the carton flaps at the top and bottom of the carton, at times an assembly line hot-melt applicator is required to apply hot-melt to the flaps of cartons that are positioned laterally. Hot-melt ejected from a nozzle for application to a vertical surface will be affected by gravity and such nozzles are more likely to drool between applications. The problem of drool is compounded when an applicator includes a plurality of nozzles which are supplied by a column of hot-melt adhesive. The lowermost nozzle will have a tendency toward drooling since gravitational force will pull the column of adhesive downward.

It is an object of the present invention to provide a low pressure nozzle system which is less likely to be adversely affected by the gravitational pull upon on-the-fly hot-melt adhesive material and which is less likely to experience drooling.

DISCLOSURE OF THE INVENTION

The above object has been met with a hot-melt adhesive dispensing nozzle system which sputters hot-melt adhesive onto surfaces at a very close range. The nozzle system disperses a stream of hot-melt adhesive into a quasi-random dot splatter pattern, termed "sputter pattern", which provides sufficient areawide coverage for joining two surfaces despite the close proximity of nozzles to the worksurface. Moreover, the nozzle system includes melt-actuated valves at least closely adjacent the nozzle outlets, thereby minimizing the possibility of drooling.

The nozzle system includes a fixed nozzle member body having an axially inward gas passageway in fluid communication with a low pressure gas supply. An annular array of material flow passageways surround the axial gas passageway of the nozzle member. The gas passageway and the material flow passageways of the nozzle member terminate at a valve seat. An axially slidably movable tubular valve member is fit within the gas passageway. The valve member includes an annular shoulder fitted about the tubular segment of the valve member. The valve member is biased rearwardly to engage the annular shoulder with the valve seat. The annular shoulder has a radial dimension sufficiently large to obstruct the material flow passageways, but the gas flow path remains unobstructed.

The valve member is yieldingly urged rearward so that a low pressure supply of hot-melt material to the material flow passageways will displace the valve member axially, thereby permitting material flow around the shoulder. A compression cap is coupled to the nozzle member and has an internal passageway diameter greater than that of any in the fixed body or the movable member. The compression cap has an array of openings at its face which are joined at least tangentially and which correspond to the material flow passageways of the nozzle member. The hot-melt material is caused to flow into the outlet openings of the compression cap. Material accumulates in the compression cap but upon impingement of the stream of gas from the nozzle and valve members, the compression cap creates a resonant condition. The oscillatory effect that takes place breaks the hot-melt stream into irregular globules as the hot-melt stream flies from the nozzle.

An advantage of the present invention is that the valve member is a material-actuated, low pressure means of sealing the material flow passageways of a nozzle from the nozzle outlet. Thus, the valve is not subjected to the high pressure actuation which is hard on valves and seats. Moreover, because the valve is disposed adjacent the nozzle outlet, a minimal amount of material is exposed to the ambient atmosphere or to an area of the nozzle beyond the valve. The material, therefore, is less likely to undergo cooling. Additionally, the valve member permits columnar nozzle dispensing without the drool which would normally occur between applications.

BEST MODE FOR CARRYING OUT THE INVENTION

Figure 1:
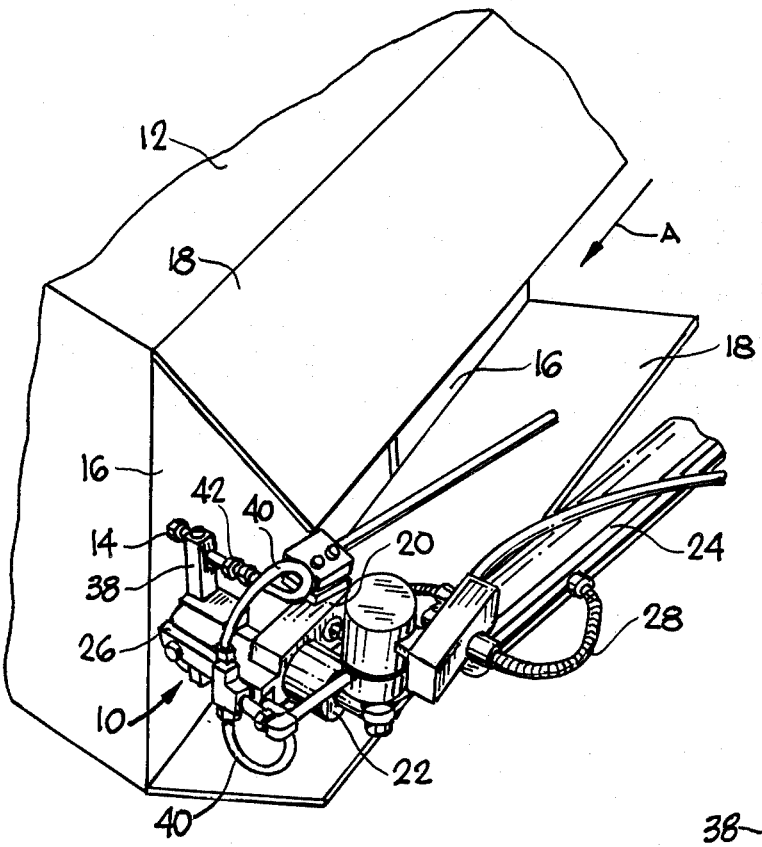
FIG. 1 is a perspective view showing exemplary apparatus utilizing the present invention in a carton sealing configuration for the application of hot-melt adhesive to carton flaps.
Figure 2:
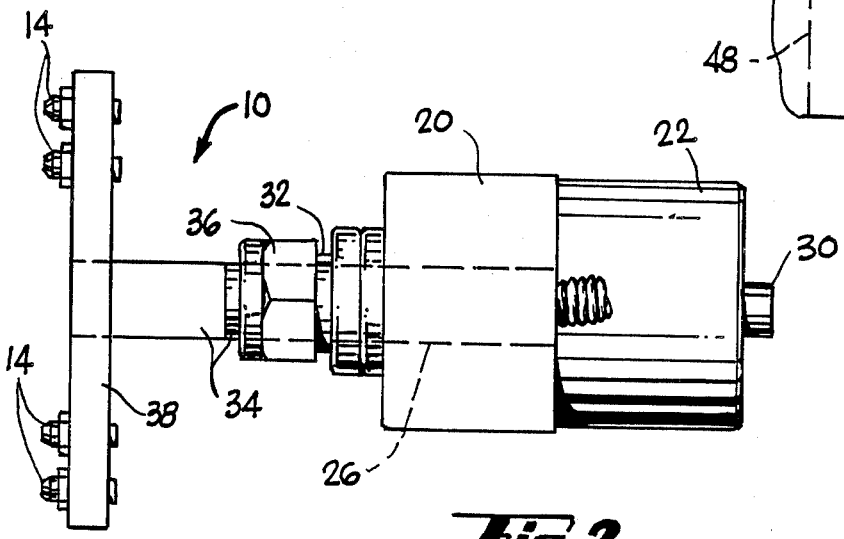
FIG. 2 is a plan view of the nozzle manifold of FIG. 1.

With reference to FIGS. 1 and 2, a nozzle manifold 10 is shown in use in an automated carton sealing assembly line. A carton 12 is positioned laterally and moves along rollers, not shown, in the direction of Arrow A. Hot-melt adhesive is sprayed from nozzles 14 onto the outside surfaces of minor flaps 16 of the carton. Major flaps 18 are thereafter brought into contact with the minor flaps 16 to effect sealing.

The nozzle manifold 10 is attached to a fixed position heated hot-melt dispenser head 20 through which hot-melt adhesive passes by means of a solenoid valve 22 from heated hose 24 connected to a melting tank, not shown. A heat transfer block 26, shown in phantom in FIG. 2, conducts heat from the heated dispenser head 20 to the nozzle manifold 10. The heat transfer block 26 should be sufficiently massive and thermally conductive to be a heat reservoir which will maintain the temperature of the nozzles 14 with a temperature drop relative to the head of 40°-50° F., without a separate heat source for the blooks. Moreover, the limited drop can be maintained for short times in the event the head momentarily loses its heat source. Dispensing head 20 may be heated electrically with power supplied through power line 28.

Hot-melt material enters the solenoid valve 22 at an inlet 30. After passing through the solenoid valve 22 and the heated dispenser head 20, the adhesive exits through outlet 32. Dispenser heads are well known and are commercially available. An inlet section 34 of the nozzle manifold 10, having a center bore, not shown, is joined to the outlet 32 of the dispenser head 20 by means of a swivel nut 36 in a direct hot-melt material dispensing line with the inlet 30. The swivel nut 36 allows tolerances for a leak-free attachment of the inlet section 34 of the manifold to both the dispenser head 20 and to the heat transfer block 26.

The inlet section 34 of the nozzle manifold is connected to a rectangularly shaped dispensing bar 38. The dispensing bar includes a longitudinal bore, not shown, which supplies hot-melt adhesive from the inlet section 34 to the nozzles 14. FIG. 1 shows separate hoses 40 and couplings 42 for supplying a stream of gas to each nozzle 14. However, the stream of gas is more preferably channeled through the longitudinal bore of the dispensing bar 38, parallel the flow of hot-melt adhesive. In this manner, the stream of gas will be heated prior to contact with the hot-melt at the nozzle outlets.

The dispensing bar 38 of a side-application nozzle manifold 10 has a vertical orientation. Thus, hot-melt material projected from a nozzle 14 is projected horizontally and, consequently, will be affected by gravitational force. The distance between nozzles 14 and a carton 12 must be minimized while still providing the areawide application needed to ensure proper sealing of the carton. An additional consideration in side application nozzle manifolds is a product of having an upright dispenser bar 38. The upright dispenser bar results in a column of hot-melt material which is urged downwardly for escape from the lowermost nozzle 14. The present invention addresses the problems inherent in horizontal application of hot-melt adhesive, but is not limited to such applications.

Figure 3:
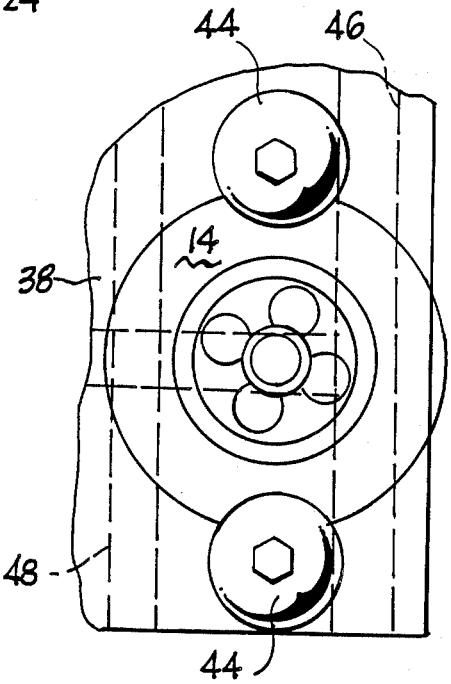
FIG. 3 is an end view of a nozzle system in accord with the present invention.

FIG. 3 is a front end view of a nozzle 14 secured to a dispenser bar 38 by hex-head screws 44. The dispenser bar has a first longitudinal bore 46 shown in phantom, which supplies hot-melt adhesive to the nozzle. A second longitudinal bore 48, also shown in phantom, connects a gas supply tank to the nozzle 14.

Figure 4:
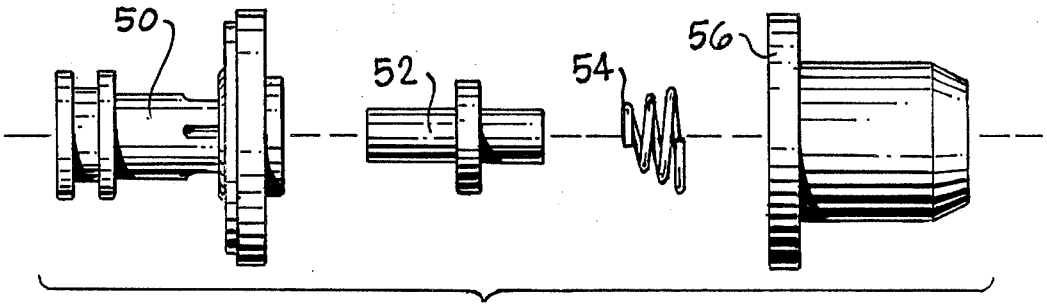
FIG. 4 is an exploded view of the nozzle system of FIG. 3.

Referring now to FIG. 4, a nozzle includes a nozzle body member 50, a valve member 52, a helical valve spring 54 and a compression cap 56. As will be shown more clearly below, the valve member 52 is slidably fit within a passageway of the nozzle body member 50. The conically helical spring 54 is fitted about an end of the valve member and contacts the compression cap 56 to yieldingly urge the valve member against the nozzle member.

Figure 7:
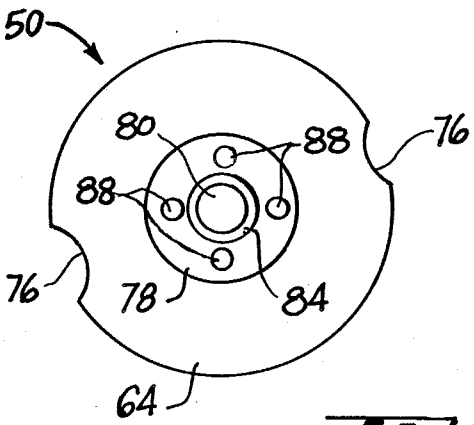
FIG. 7 is a front view of the shuttle member of FIG. 5.
Figure 5:
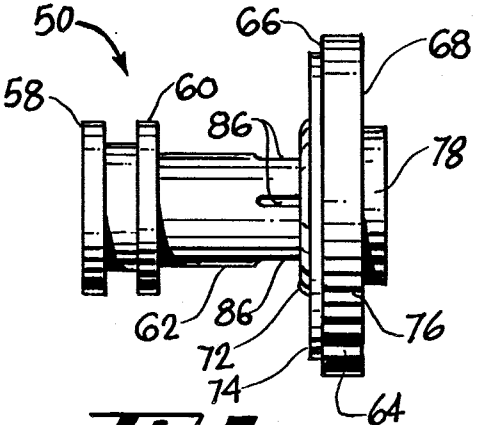
FIG. 5 is a side view of the shuttle member of FIG. 4.
Figure 6:
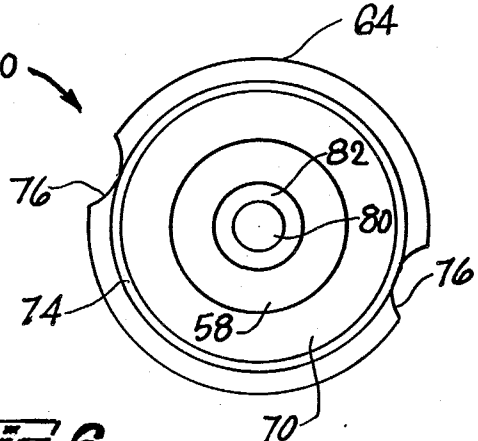
FIG. 6 is a rear view of the shuttle member of FIG. 5.

The nozzle body member 50 may be seen in more detail in FIGS. 5-7. The nozzle body member is a brass material having first and second flanges 58 and 60 spaced apart for retention of a sealing O-ring, not shown. A cylindrical midsegment 62 of the nozzle body member mushrooms to form an annular engagement shoulder 64 for contact with a dispensing bar at a rear surface 66 and contact with a compression cap at a forward surface 68. The rear surface 66 has an O-ring seat 70 defined by a stepped region 72 and an O-ring retention rim 74. As noted above, a nozzle 14 is secured to a dispenser bar by means of hex head screws. For this reason the engagement segment 64 includes opposed notches 76 which provide clearance for the threads of a screw. A cylindrical valve seat 78 projects from the forward surface 68 of the engagement segment 64.

A gas passageway 80 along the longitudinal axis of the nozzle member 50 provides a portion of a gas flow path through a nozzle. The gas passageway 80 of the nozzle member illustrated in FIGS. 5-7 has a varying diameter. An inlet section 82 of the gas passageway has a truncated conical shape to permit acceleration of a given stream of gas which enters the nozzle member. While the dimensions of the inlet section is not critical to the proper operation of the nozzle, the acceleration aids in minimizing the required gas pressure that must be supplied to a nozzle to achieve a desired result. At the downstream end of the gas passageway there is a minor widening, as seen at 84 of FIG. 7. This widening facilitates mating of a valve member with a nozzle member.

The cylindrical midsegment 62 of a nozzle member 50 includes openings 86 which lead to a square array of material passageways 88 that partially define a hot-melt material flow path through a nozzle. While a square array is preferred, other geometrically regular arrays of material passageways are possible, such as at the corners of a regular triangle or a regular pentagon. The number of material passageways is not critical since, if desired, the nozzle will function with use of a single nozzle. Each material passageway 88 is equidistant from the gas passageway 80.

Figure 11:
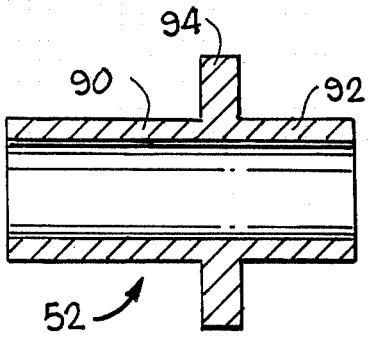
FIG. 11 is a side sectional view of the valve member of FIG. 4.

Referring briefly to FIG. 11, the valve member 52 includes a first tubular segment 90 which is slidably fit within a gas passageway 80 of the nozzle body member of FIG. 5. The valve member further includes a second tubular segment 92 that is spaced apart, at least externally, from the first tubular segment 90 by an annular shoulder 94. The shoulder 94 has a radial dimension sufficiently great to cover the material passageways 88 of a nozzle member. The tubular body of the valve member 52, however, permits gas flow through the nozzle to pass unobstructed. FIG. 11 shows a single configuration of a valve member.

Figure 10:
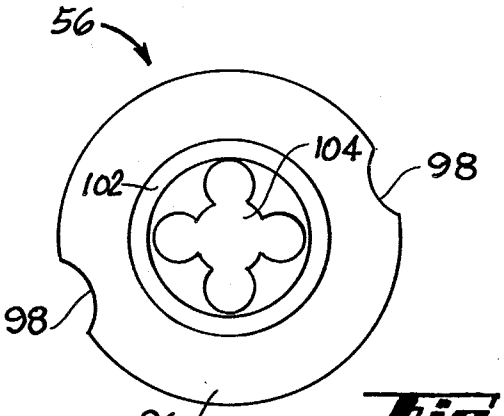
FIG. 10 is a front view of the compression cap of FIG. 8.
Figure 8:
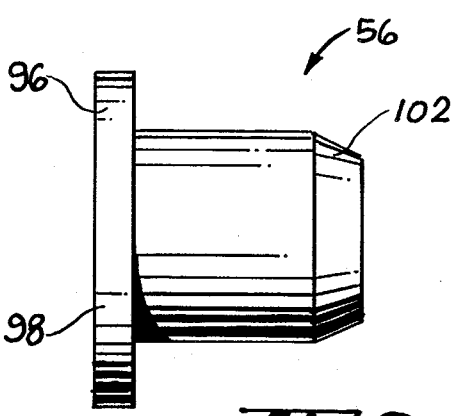
FIG. 8 is a side view of the compression cap of FIG. 4.
Figure 9:
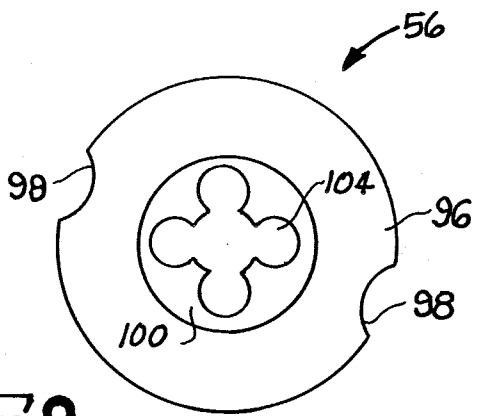
FIG. 9 is a rear view of the compression cap of FIG. 8.

FIGS. 8–10 illustrate a compression cap 56 in detail. The compression cap has an annular engagement shoulder 96 which abuts a forward surface 68 of the shoulder 64 of fixed nozzle body member 50 when a nozzle 14 is fully assembled. Shoulder 96 has about equal dimensions to shoulder 64. Like the nozzle member, the compression cap includes notches 98 to provide clearance for the threads of a screw. The compression cap 56 has a recess 100 at the rearward end for receipt of a helical spring 54, the valve member 52 and the valve seat 78 of a nozzle member 50. Tapering 102 at the forward end of the compression cap reduces the risk of adhesive material drool.

A cloverleaf orifice 104 in the compression cap 6 provides an opening for escape of both a stream of gas and a stream of hot-melt material from a nozzle. The area of the orifice is less than the cross section of the passageway in the cap. The cloverleaf orifice 104 comprises a square array of four openings joined at a center. Alignment of the notches 98 of the compression cap with the notches 76 of a nozzle body member 50 will align the square array of openings with the material passageways 88. The configuration of the orifice 104 is not critical but the orifice should be closely aligned with the configuration of the material passageways 88.

Figure 12:
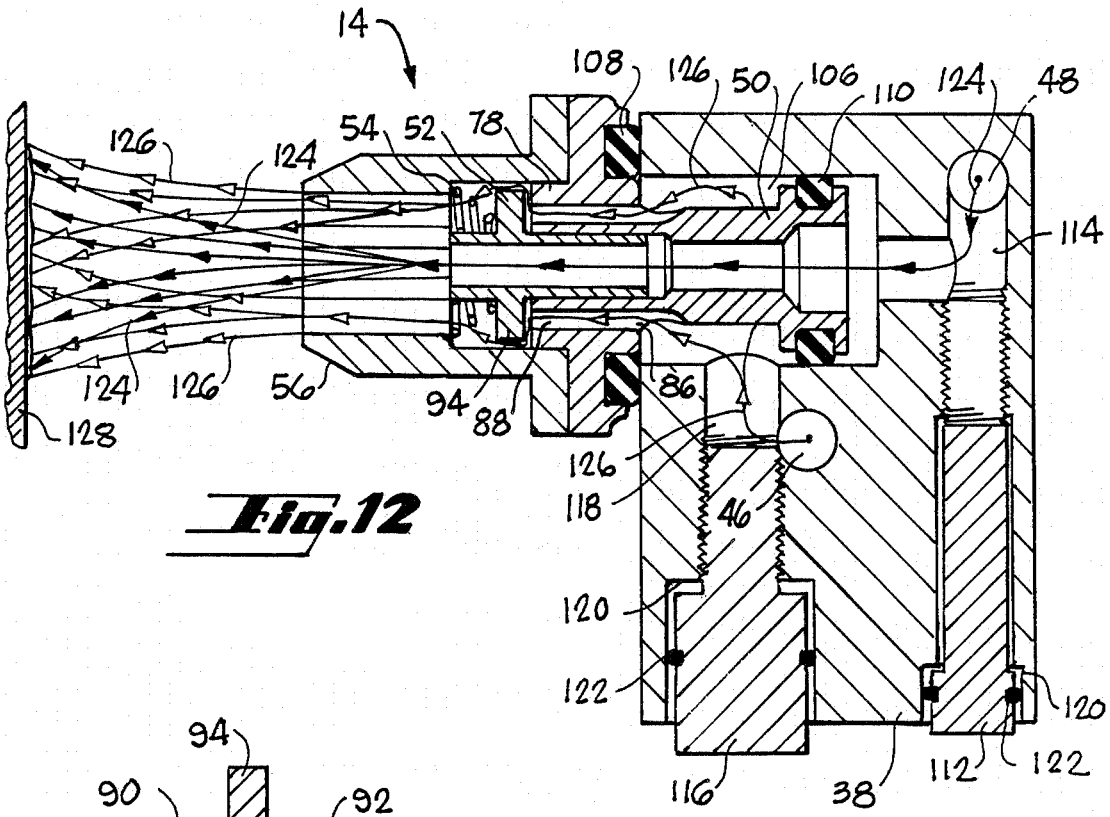
FIG. 12 is an operational view of the nozzle system of FIG. 1.

FIG. 12 illustrates a nozzle 14 coupled to a nozzle recess 106 in a dispenser bar 38. A forward O-ring 108 and a rearward O-ring 110 are provided to prevent pressure leakage.

A gas restriction bolt 112 regulates the gas flow from the longitudinal bore 48 of the dispenser bar 38. The gas restriction bolt 112 is threaded into a gas restriction bore 114 which permits gas flow from the longitudinal bore 48 to the nozzle 14. Rotation of the bolt 112 regulates gas flow to the nozzle by interfering with the fluid communication of the longitudinal bore 48 with the nozzle. In like manner, a material restriction bolt 116 regulates hot-melt material flow from the longitudinal bore 46 through a threaded material restriction bore 118 and to the nozzle 14. A method of regulating hot-melt material pressure and gas pressure at individual nozzles is especially important in applications having a columnar arrangement of nozzles, since without such a method pressure would decrease after each succeeding nozzle. Moreover, in the case of material flow, pressure is increased at the lowermost nozzle of a column of nozzles because of the mass of the column of material. Each restriction bore 114 and 118 has a shoulder 120 and each restriction bolt 112 and 116 has an O-ring 122, thereby preventing pressure leakage.

In operation, the flow path 124 of the gas is an inner flow path. That is, the gas flow path is surrounded by the outer hot-melt material flow path 126. The two flow paths 124 and 126 are prevented from communicating by the rearward O-ring 110. The gas flow path 124 extends from the longitudinal bore 48 of the dispensing bar 38, through the gas passageway of the nozzle member 50, and through the valve member 52, whereupon the stream of gas will begin to expand.

The axially outward hot-melt material flow path 126 extends from the longitudinal bore 46 and material enters the nozzle member 50 at side openings 86 for passage through the material passageways 88. At the termination of the material passageways 88 a stream of hot-melt material will encounter the shoulder 94 of the valve member 52. The valve member is biased by helical valve spring 54 to block flow from the nozzle member. The valve spring, however, yieldingly urges the valve member, so that the valve member is capable of axial movement when a threshold hot-melt material pressure is reached. Nozzles 14 operate at low pressure, with hot-melt being at a pressure of less than 150 pounds per square inch and the gas stream being at a pressure less than ten pounds per square inch. In an automated assembly line application the hot-melt material is repeatedly pressurized and then depressurized. When pressurized the hot-melt material exceeds the threshold pressure which is required to move the shoulder 94 from the valve seat 78 of the nozzle member 50. Hot-melt material may then flow around the shoulder 94. Upon depressurization of the hot-melt material, the shoulder will once again seat against the nozzle member. Thus, the tendency of the lowermost nozzle in a column of nozzles to drool is overcome.

A stream of hot-melt material that progresses downstream of the shoulder 94 of the valve member 52 will enter the cloverleaf orifice of the compression cap 56. The openings along the cloverleaf orifice act as lips upon which a mass of hot-melt material will begin to accumulate. The compression cap creates a resonant condition whereupon impingement of the stream of gas onto the hot-melt material produces an oscillatory effect which sprays the hot-melt onto a worksurface 128 in an irregular but regulated pattern. This quasi-cavitational resonance is within the audible range. Because the present invention utilizes an axially inward gas flow path to disperse an axially outward stream of material, sufficient areawide coverage is possible at a distance as close as two inches. Such short distances are favorable because heat in the melt is preserved against air cooling.

The hot-melt material is applied to a work-surface 128 in a stripe pattern. The width of the stripe and the maximum size of a globule that strikes the work-surface may be regulated by adjusting the gas flow pressure and/or the material flow pressure either at the sources or by rotation of regulating bolts 112 and 116. The gas should impinge the material flow in a manner which causes the formation of irregular sized globules which have sufficient mass to remain molten after contact with a first surface, yet are not so massive as to be significantly deflected by gravity from travel to a target or from providing a sufficient amount of areawise coverage upon the worksurface. It is intended that the fluid stream directed toward a target surface provide an areawise coverage in a quasi-random splatter pattern.

While the present invention has been described with reference to an applicator which provides horizontal sputtering onto a worksurface, it is understood that the valved nozzle may be employed for application onto a horizontal worksurface. Additionally, the present invention may be used for applications other than the sealing of cartons or used with materials other than hot-melt adhesive.

I claim:

1. A nozzle for spraying of viscous fluid material comprising, a nozzle body having an outlet face at a forward end, and having a longitudinal axis and axially inward and axially outward fluid flow paths, gas supply means in fluid communication with said axially inward fluid flow path to yield at least one gas passageway having a termination at least closely proximate said outlet face, viscous fluid material supply means in fluid communication with said axially outward fluid flow path, said axially outward fluid flow path having at least one material flow passageway at least partially coextensive with said gas passageways, a valve member disposed at least closely adjacent said outlet face, said valve member having an interior wall defining a gas passage bore in fluid communication with said axially inward fluid flow path of said nozzle body, said valve member having a sealing means for selectively isolating said material flow passageways from communication with said outlet face, and biasing means for urging said valve member away from said outlet face and for urging said sealing means into a rest position isolating said material flow passageways, said biasing means having a force exceeding the force exerted upon said valve member by gas passage therethrough.

2. The nozzle of claim 1 wherein said valve member has a tubular segment in fluid communication with said gas supply means.

3. The nozzle of claim 2 wherein said tubular segment of said valve member is slidably coupled to a gas passageway, said valve member fitted to said nozzle body for axial movement in relation thereto.

4. The nozzle of claim 2 wherein said valve member has an annular shoulder portion fitted about said tubular segment, said shoulder portion having a radial dimension sufficient for sealing said material flow passageways.

5. The nozzle of claim 1 wherein said biasing means is a spring.

6. The nozzle of claim 1 wherein said outlet face of said nozzle body has a plurality of outlet openings corresponding in number to the material flow passageways, said outlet openings being at least tangentially connected.

7. The nozzle of claim 6 wherein each outlet opening has an axis at least closely axially aligned within an associated material flow passageway.

8. The nozzle of claim 1 having an annulus of material flow passageways, each material flow passageway being equidistantly spaced from adjacent passageways.

9. A nozzle for spraying viscous fluid material comprising, a nozzle member having a longitudinal axis and a valve seat and having structure defining an axially inward gas passageway and at least one axially outward material flow passageway, said material flow passageways terminating at said valve seat, said gas passageway and said material flow passageways being coextensive at said valve seat, a valve member slidably fit to said nozzle member for axial movement relative thereto, said valve member having a seal means for obstructingly engaging said valve seat and having an interior wall defining a gas passage bore in fluid communication with said gas passageway, biasing means for yieldingly urging said valve member for engagement with said valve set, said biasing means having a force exceeding the force exerted upon said valve member by gas passage therethrough, and a compression cap joined with said nozzle member, said compression cap having outlet openings in fluid communication with said gas passage bore and said material flow passageway.

10. The nozzle of claim 9 wherein said valve member has a first tubular end segment slidably fit within said gas passageway, said valve member being in fluid communication with said gas passageway.

11. The nozzle of claim 10 wherein said seal means of said valve member is an annular shoulder fit about said first tubular end segment, said annular shoulder having a radial dimension sufficient for sealing said material flow passageways.

12. The nozzle of claim 11 wherein said valve member has a second tubular end segment in fluid communication with said first tubular end segment.

13. The nozzle of claim 9 wherein said biasing means is a spring means disposed between said valve member and said compression cap.

14. The nozzle of claim 9 having a plurality of material flow passageways disposed equidistantly about the longitudinal axis of said nozzle member.

15. The nozzle of claim 9 wherein said outlet openings of the compression cap correspond in number to the material flow passageways, said outlet openings being at least tangentially connected.

16. A nozzle for spraying of viscous fluid material comprising, a nozzle body having an outlet face at a forward end, and having a longitudinal axis and axially inward and axially outward fluid flow paths, gas supply means in fluid communication with said axially inward fluid flow path to yield at least one gas passageway, viscous fluid material supply means in fluid communication with said axially outward fluid flow path, said axially outward fluid flow path having a plurality of material flow passageways at least partially coextensive with said gas passageway, said outward face of the nozzle body having a plurality of outlet openings corresponding in number to the material flow passageways, said outlet openings being at least tangentially connected, a valve member disposed at least closely adjacent said outlet face, said valve member having a sealing means for selectivley isolating said material flow passageways from communication with said outlet face, and biasing means for urging said valve member rearwardly, away from said outlet face.

17. The nozzle of claim 16 wherein each outlet opening has an axis at least closely axially aligned within an associated material flow passageway.

* * * * *